US010579087B2

(12) United States Patent
Bink et al.

(10) Patent No.: US 10,579,087 B2
(45) Date of Patent: Mar. 3, 2020

(54) SYSTEM, APPARATUS AND METHOD FOR FLEXIBLE CONTROL OF A VOLTAGE REGULATOR OF AN INTEGRATED CIRCUIT

(71) Applicant: Silicon Laboratories Inc., Austin, TX (US)

(72) Inventors: Adrianus Bink, Oslo (NO); Wajid Hassan Minhass, Oslo (NO); Pio Balmelli, Arogno (CH); Ricky Setiawan, Singapore (SG)

(73) Assignee: Silicon Laboratories Inc., Austin, TX (US)

( * ) Notice: Subject to any disclaimer, the term of this patent is extended or adjusted under 35 U.S.C. 154(b) by 0 days.

(21) Appl. No.: 15/968,996

(22) Filed: May 2, 2018

(65) Prior Publication Data

US 2019/0339729 A1 Nov. 7, 2019

(51) Int. Cl.
*G05F 3/08* (2006.01)

(52) U.S. Cl.
CPC ..... *G05F 3/08* (2013.01)

(58) Field of Classification Search
CPC .... G05F 1/10; G05F 1/46–70; G05F 3/02–30; G06F 1/26; G06F 1/263; G06F 1/2666; G06F 1/3203; G06F 1/3206; G06F 1/3212; G06F 1/3215; G06F 1/3225; G11C 5/147; G11C 5/148
See application file for complete search history.

(56) References Cited

U.S. PATENT DOCUMENTS 6,058,061 A * 5/2000 Ooishi ..... G11C 7/06 365/222
6,795,366 B2 * 9/2004 Lee ..... G05F 1/465 365/189.09
7,181,631 B2 * 2/2007 Volk ..... G06F 1/26 713/300
7,265,605 B1 * 9/2007 Vasudevan ..... G05F 1/56 327/534
8,629,713 B2 * 1/2014 Pietri ..... H03K 17/22 327/143
9,323,272 B2 * 4/2016 Rana ..... G05F 3/16
2007/0069807 A1 * 3/2007 Ho ..... G06F 1/28 327/541
2010/0219687 A1 * 9/2010 Oh ..... G05F 1/46 307/39
2017/0063229 A1 3/2017 Powell
2017/0093399 A1 3/2017 Atkinson et al.

* cited by examiner

*Primary Examiner* — Thomas J. Hiltunen
(74) *Attorney, Agent, or Firm* — Trop, Pruner & Hu, P.C.

(57) ABSTRACT

In an embodiment, an integrated circuit includes: a voltage regulator to receive a first voltage and regulate the first voltage to output a regulated voltage; a first logic circuit to operate using the regulated voltage; and a regulator control circuit to receive a control signal during a boot of the integrated circuit via a general purpose pad of the integrated circuit and control the voltage regulator to operate in one of an enabled mode and a bypass mode based at least in part on the control signal.

18 Claims, 7 Drawing Sheets

SYSTEM, APPARATUS AND METHOD FOR FLEXIBLE CONTROL OF A VOLTAGE REGULATOR OF AN INTEGRATED CIRCUIT

BACKGROUND

Modern integrated circuits (ICs) house vast amounts of computing and other processing capabilities. Internal circuitry of such ICs may operate at different voltage levels. Such voltages are provided, at least initially from off-chip sources. To this end, integrated circuits include multiple power and ground connections, often referred to as pins or pads. Signaling requirements of an integrated circuit also consume large amounts of pins/pads. However, inclusion of additional pins/pads to accommodate a variety of specialized purposes increases chip real estate and power consumption costs, and raises routing and other complexities. As a result, most integrated circuits are constrained in the use of pins/pads, particularly as shrinking die and IC size compels consumption of fewer pin/pads.

SUMMARY OF THE INVENTION

In one aspect, an integrated circuit includes: a voltage regulator to receive a first voltage and regulate the first voltage to output a regulated voltage; a first logic circuit to operate using the regulated voltage; and a regulator control circuit to receive a control signal during a boot of the integrated circuit via a general purpose input/output (GPIO) pad of the integrated circuit and control the voltage regulator to operate in one of an enabled mode and a bypass mode based at least in part on the control signal.

The integrated circuit may include: a first power pad to receive a first supply voltage, the first power pad coupled to the regulator control circuit to provide the first supply voltage to the regulator control circuit; and a second power pad to receive a second supply voltage, the second power pad coupled to the voltage regulator to provide the second supply voltage to the voltage regulator. The integrated circuit may further include a bypass circuit coupled between the second power pad and the first logic circuit. In the bypass mode, the second power pad is to receive a third supply voltage, the third supply voltage less than the second supply voltage, and the bypass circuit is to provide the third supply voltage to the first logic circuit. In the enabled mode, the second power pad is to receive the second supply voltage and provide the second supply voltage to the voltage regulator.

The regulator control circuit may be configured to send at least one signal to the bypass circuit to control the bypass circuit. The regulator control circuit may further be configured to register a state of the control signal in response to a release of a reset signal. When the state of the control signal is active, the regulator control circuit may control the voltage regulator to operate in the bypass mode. In an example, the GPIO pad is an overloaded pad to receive the control signal during the boot of the integrated circuit and to receive at least one other signal during normal operation of the integrated circuit. The regulator control circuit may control the voltage regulator to operate in the bypass mode during a debug operation on the integrated circuit, and otherwise to control the voltage regulator to operate in the enabled mode.

In another aspect, a method includes: in response to a release of a reset signal provided to an integrated circuit via a reset pin, registering a state of a second signal provided to the integrated circuit via a second pin, where after the reset signal release, the second pin is useable for another function. The method further includes, in response to the registered state being a first state, controlling a voltage regulator of the integrated circuit for a bypass mode in which a first external supply voltage provided to the integrated circuit via a third pin is to power at least one logic circuit of the integrated circuit.

In an example, the method includes overloading the second pin with another signal for the another function after the reset signal release. The method may further include executing a scan operation on the integrated circuit using the first external supply voltage while the voltage regulator is controlled for the bypass mode. In response to the registered state being a second state, the method may include controlling the voltage regulator for an enabled mode in which the voltage regulator regulates the first external supply voltage to provide a regulated voltage to the at least one logic circuit.

In an example, the method further includes receiving a general purpose input/output signal via the second pin after the reset signal release. The method also may include receiving the state of the second signal in a regulator control circuit of the integrated circuit, the regulator control circuit powered by the first external supply voltage provided via the third pin. The state of the second signal may be received in a regulator control circuit of the integrated circuit, the regulator control circuit powered by another external supply voltage provided to the integrated circuit via a fourth pin of the integrated circuit.

In another aspect, an apparatus includes: a first pin to receive a reset signal to indicate a reset of the apparatus; a second pin to receive a control signal during a boot of the apparatus, and after a release of the reset signal to receive another signal; a voltage regulator to receive a first supply voltage and give a regulated output voltage; a control circuit to receive the control signal via the second pin and the reset signal via the first pin during the boot of the apparatus, and control the voltage regulator to operate in one of an enabled mode and a bypass mode based on a state of the control signal at the release of the reset signal; and a first logic circuit to operate using the first supply voltage when the voltage regulator is to operate in the bypass mode and using the regulated voltage when the voltage regulator is to operate in the enabled mode.

The apparatus may further include: a first power pad to receive the first supply voltage, the first power pad coupled to the voltage regulator to provide the first supply voltage to the voltage regulator; and a second power pad to receive a second supply voltage, the second power pad coupled to the control circuit to provide the second supply voltage to the control circuit. Still further, the apparatus may include a bypass circuit coupled between the first power pad and the first logic circuit, where in the enabled mode the bypass circuit is disabled and the first power pad is to receive a third supply voltage, the third supply voltage greater than the first supply voltage, and in the bypass mode the bypass circuit to provide the first supply voltage to the first logic circuit.

DETAILED DESCRIPTION

In various embodiments, an integrated circuit having at least one on-chip voltage regulator may be flexibly controlled to cause the voltage regulator to operate in one of an enabled mode in which the voltage regulator is to provide a regulated voltage to one or more logic circuits of the integrated circuit and a bypass mode in which another voltage source is provided to such one or more logic circuits. The control mechanism for mode selection may be by way of a signal received in the integrated circuit via a given pin of the integrated circuit. More specifically, this signal provided to the integrated circuit during a boot operation of the integrated circuit may be used to control the voltage regulator mode (namely enabled or bypass). Thereafter, the pin on which this signal is provided may be used for other purposes. In this way, the need for a dedicated pin to provide a control signal for voltage regulator control can be avoided, reducing pin count and complexity.

While this flexible control of voltage regulator operating mode may occur during normal operation of the integrated circuit within a computing device or other apparatus, understand that typical use cases may be for use during debug and test operations on the integrated circuit. As an example, an integrated circuit may be coupled to a tester or other debug test system for purposes of debug operation. In such debug operation, the debugger may send the signal to control operation mode of the voltage regulator based on a type of testing to be performed.

With embodiments herein, an integrated circuit can be designed that includes fewer numbers of pins, while still providing for great flexibility for debug and other test cases in a manner that may remain hidden to end users. That is, one or more pins may be used to control, e.g., voltage regulator operation mode, during debug or test operations on the integrated circuit. These same one or more pins may be used during normal operation of the integrated circuit for a wide variety of purposes, such as generic signaling, ground or other reference voltage provision and so forth.

Furthermore, while a representative use case described herein is in the context of voltage regulator mode control, embodiments are not so limited. That is, in other examples a control signal received during boot up of the integrated circuit can be used to control other components of the integrated circuit, leveraging one or more pins that may be used for other purposes during normal operation. As an example, control signaling received on one or more pins during integrated circuit boot up may be used to control additional components, such as an on-chip DC-DC voltage converter or so forth. In turn, the same one or more pins may be adapted for any end user-desired use during normal integrated circuit operation.

Figure 1A:
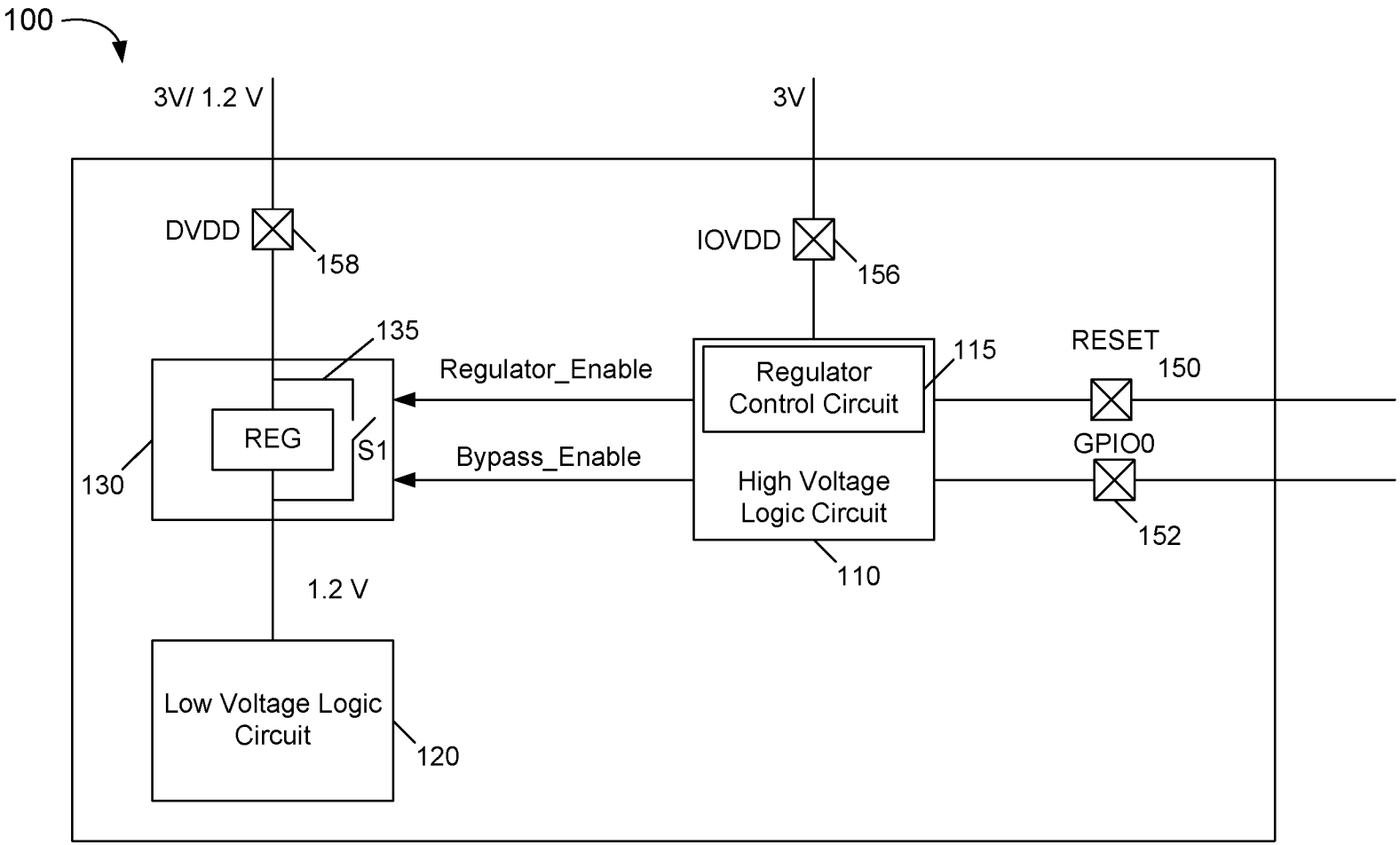
FIG. 1A is a block diagram of an integrated circuit in accordance with an embodiment.

Referring now to FIG. 1A, shown is a block diagram of an integrated circuit in accordance with an embodiment. More specifically as shown in FIG. 1A, integrated circuit 100 may be any type of circuit, such as a wireless transceiver, microcontroller or so forth. In some cases, integrated circuit 100 may be implemented with a single semiconductor die adapted within a package of integrated circuit 100. In other cases, multiple die may be included within a package such as a multi-chip module.

In the high level shown in FIG. 1A, integrated circuit 100 includes a first logic circuit 110 and a second logic circuit 120. More specifically, first logic circuit 110 may be a high voltage logic circuit, in that it includes logic circuitry to be powered at a first voltage level, e.g., at 3.0 volts. Various circuitry may be located within first logic circuit 110, such as high voltage logic circuitry, formed of transistors and other devices that are capable of operation at this first voltage level. Notably, first logic circuit 110 may include start up circuitry for integrated circuit 100 such that upon boot up of integrated circuit 100, circuitry within first logic circuit 110 may operate at this first voltage level to perform initialization operations and so forth. In addition, first logic circuit 110 may also include control mechanisms for reset, isolation, voltage regulators, clock circuits and so forth.

In turn, second logic circuit 120 may be a low voltage logic circuit that includes circuitry to be powered at a lower second voltage level, e.g., at 1.2 volts. As an example, such circuitry may include digital circuitry to perform processing operations, digital control operations and so forth. Such digital circuitry may include transistors and other devices that operate using a lower voltage, namely at this second voltage level.

As further illustrated, integrated circuit 100 also includes an on-chip voltage regulator 130. In embodiments, regulator 130 may be a low dropout (LDO) regulator controlled to operate in one of an enabled mode and a bypass mode. More specifically, at least one switch S1 may be adapted along a bypass path 135 that is coupled in parallel with an input to voltage regulator 130 and an output of voltage regulator 130. As such, when voltage regulator 130 is to operate in the enabled mode, switch S1 is opened, such that an incoming voltage provided to an input to voltage regulator 130 is processed in voltage regulator 130 and output as a regulated voltage, e.g., at a lower voltage, to second logic circuit 120.

Instead, when voltage regulator 130 is to operate in the bypass mode, switch S1 is closed, such that the input voltage is output directly via bypass path 135 to second logic circuit 120. As an example, bypass mode may be used to enable integrated circuit 100 to boot directly from an external supply voltage. This mode may occur for enabling functional testing of integrated circuit 100 even where voltage regulator 130 may have suffered a failure condition. Similarly, this bypass mode may be used to execute a scan operation using an external supply voltage, which may simplify regulator design.

As further illustrated in FIG. 1A, various pads within integrated circuit 100 provide an interface with off-chip components, such that power and signaling can be communicated to on-chip components (and vice-versa). Note that such pads are conductive elements formed on a given semiconductor die to provide a location for contact to off-die pins. As an example, pads may couple via bond wires to respective conductive pins, bumps or any other conductive connection of integrated circuit 100 (generally referred to herein as "pins") that in turn couple to, e.g., a circuit board of a given system. Further in use cases where an integrated circuit is being tested, the integrated circuit may be coupled to a test apparatus so that connection is made between circuitry of the tester and such pins.

More specifically as illustrated in FIG. 1A, first logic circuit 110 receives a reset signal via a first pad 150 (and in turn from a first pin of integrated circuit 100 (e.g., a reset pin), not shown in FIG. 1A) and further receives a control signal via another pad 152 (and in turn from a second pin of integrated circuit 100, not shown in FIG. 1A), which in an embodiment may be a general purpose input-output (GPIO) pad. As such, incoming signaling information may be provided via pad 152 to logic circuit 110 and similarly, output signaling information may be output via pad 152. In addition, a power pad 156 is used to provide a first supply voltage to first logic circuit 110, namely a 3.0 volt voltage. And similarly another power pad 158 is used to provide a second supply voltage to voltage regulator 130 and/or second logic circuit 120. As illustrated, this second supply voltage may be at either a 3.0 or 1.2 volt level. Also understand that it is possible for a single power pad to be provided to receive a single incoming voltage that is provided both to logic circuits 110 and 120. In such instance, it may be possible for logic circuit 110 to operate on both a low voltage and a high voltage, thereby reducing pin count.

To effect control of voltage regulator 130, first logic circuit 110 includes a regulator control circuit 115. In embodiments herein, regulator control circuit 115 is configured to receive the reset signal via reset pad 150 and the control signal via GPIO pad 152. In an embodiment, the reset signal may be used as a clock signal and the control signal may be used as a select line to control the determination of voltage regulator operation mode. Based on the state of these two signals, regulator control circuit 115 may output one or more corresponding control signals, namely a Regulator_Enable signal and a Bypass_Enable signal, to control operation of voltage regulator 130. Understand while shown at this high level in the embodiment of FIG. 1A, a given integrated circuit may include much additional circuitry. Furthermore, while representative logic circuits to be powered by representative voltages and regulated voltages are shown for ease of illustration, understand that the techniques described herein may be applied for control of multiple on-chip voltage regulators or other on-chip components with limited pin support.

Figure 1B:
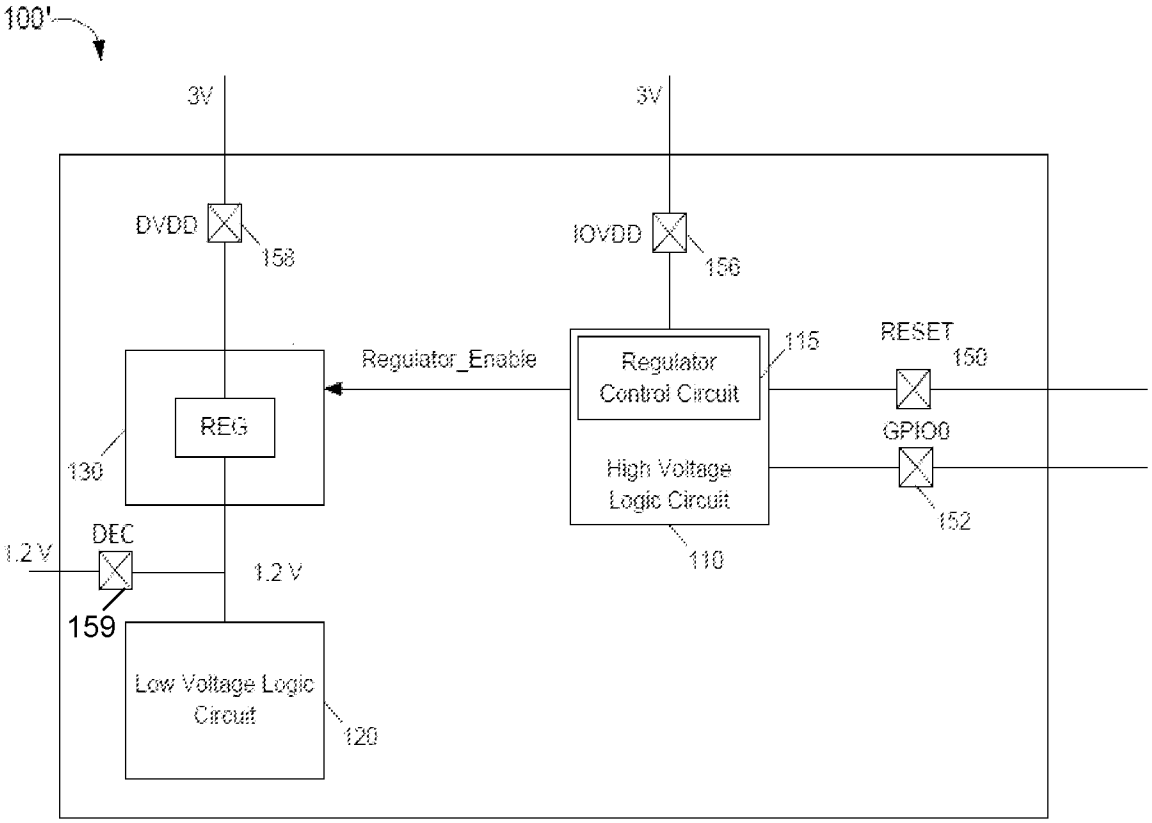
FIG. 1B is a block diagram of an integrated circuit in accordance with another embodiment.

Referring now to FIG. 1B, shown is a block diagram of an integrated circuit in accordance with another embodiment. More specifically, in FIG. 1B, integrated circuit 100' may be implemented substantially the same as integrated circuit 100 of FIG. 1, and thus the same reference numerals are used to refer to the same components. In the embodiment of FIG. 1B however, the bypass switch associated with voltage regulator 130 is removed. In addition, a third power pad 159 (DEC) is present and coupled to low voltage logic circuit 120. As shown in FIG. 1B, the received supply voltage via pad 159 is at a low voltage (1.2 volts) and in turn, a single high voltage source (e.g., 3 volts) is provided to power pads 156, 158. Understand that these power pads may be combined into a single pad. In this way, a solution with two power pads can be realized.

With this implementation, when regulator 130 is enabled, power pad 159 is not powered from outside the chip and the regulated output voltage of regulator 130 powers logic circuit 120. During a bypass mode, regulator 130 is disabled and power pad 159 is powered from outside the chip to supply a low voltage to logic circuit 120.

Figure 2:
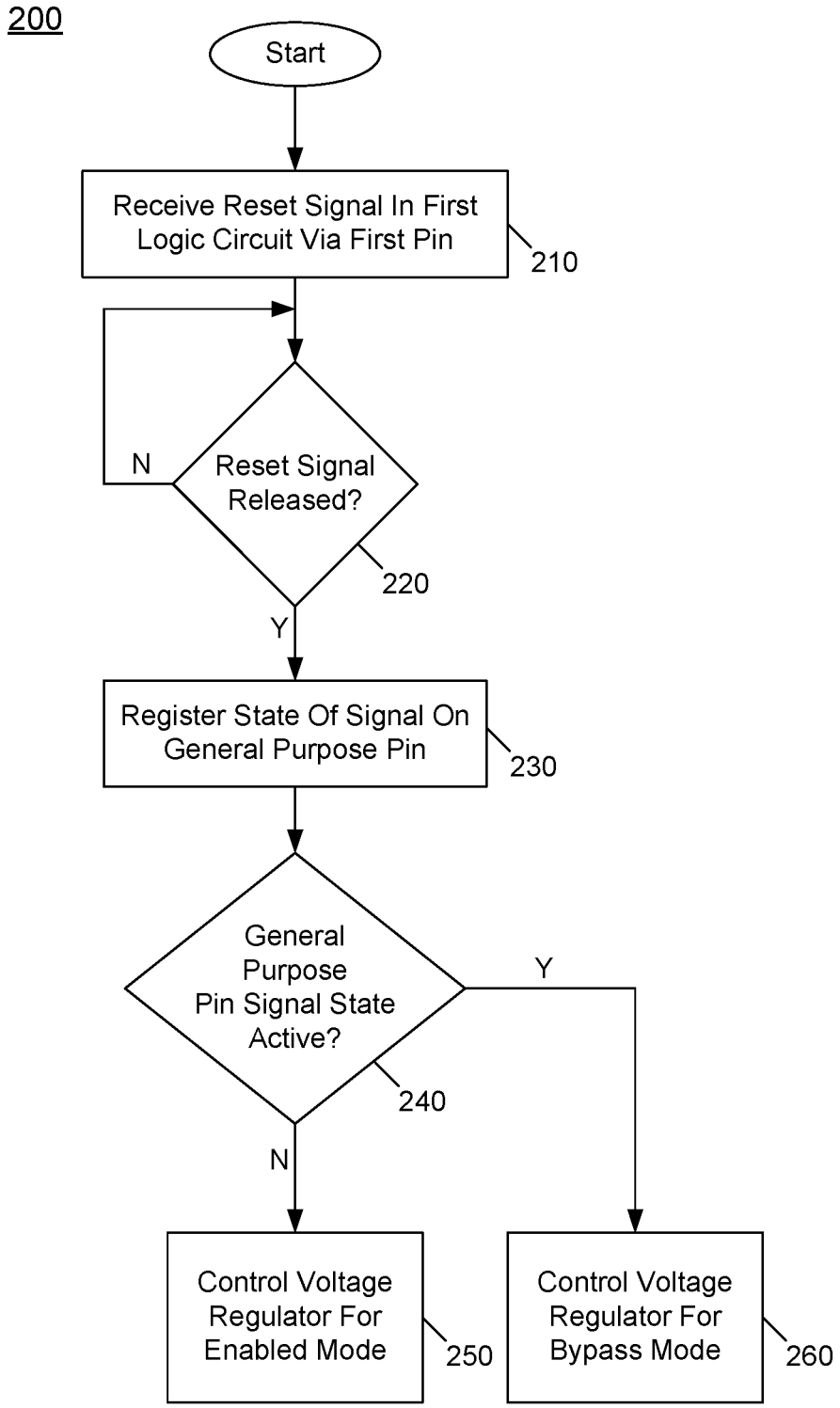
FIG. 2 is a flow diagram of a method in accordance with an embodiment.

Referring now to FIG. 2, shown is a flow diagram of a method in accordance with an embodiment. More specifically, method 200 shown in FIG. 2 is a method for controlling a voltage regulator in accordance with an embodiment. In different implementations, method 200 may be performed by hardware circuitry, firmware, software and/or combinations thereof. In a particular embodiment as in FIG. 1A, regulator control circuit 115 may execute method 200. As such, regulator control circuit 115 may include or be coupled to a non-transitory storage medium including instructions that when executed enable it to execute method 200.

As illustrated, method 200 begins by receiving a reset signal in a first logic circuit via a first pin (block 210). In one example, this reset signal may be sent by a host processor of a computing system including the integrated circuit, e.g., on boot or other reset of the system. This reset signal may be of an inactive or low state when the system is undergoing reset. Although it is possible for this reset signal to be communicated on system reset during normal system operation, in many example use cases, the voltage regulator control of FIG. 2 may occur during debug or other test operations such as when the integrated circuit is adapted to a test structure, debugging system or so forth. In such cases, this reset signal is a signal communicated by the test system to cause the integrated circuit to be reset and to boot up, e.g., for purposes of test operations, scan operations or so forth.

Regardless of the source of the reset signal, still with reference to FIG. 2, control passes to diamond 220 where it is determined whether this reset signal is released. Such reset release occurs when reset is completed and the reset signal changes state to an active state (e.g., a logic high). At this point, this signal thus indicates that the system is ready for normal operation, having completed its reset operations.

Still with reference to FIG. 2, control next passes to block 230 where a state of a signal on a general purpose pin may be registered. More specifically, the value on this selected pin (e.g., a first GPIO pin (which may be identified as GPIO0)) may be determined and optionally stored in a storage location, e.g., a register of the control circuit. In one particular embodiment, the regulator control circuit may include a latch circuit such as a D-type flip-flop having a data input to receive the control signal and a clock input to receive the reset signal. In such implementation, when the reset signal is released (e.g., goes logic high), the value of the control signal is thus registered and output from the flip-flop as a control value. As discussed, this control value may be stored in a register. Still further as described below this control value also may be used to control operation mode of the voltage regulator.

More specifically, based on this registering or reading of the signal, it is determined whether this signal state is active or logic high (diamond 240). If not, control passes to block 250 where the voltage regulator may be controlled to be in an enabled mode. To this end, the regulator control circuit may send one or more control signals (e.g., an active regulator enable signal) to cause the voltage regulator to be enabled for normal operation. As such, the voltage regulator receives an input voltage, regulates it to a regulated voltage level, e.g., at a lower voltage level, and outputs the regulated voltage (which may be used to power one or more logic circuits of the integrated circuit). Instead, if the signal state is active or logic high, control passes to block 260 where the voltage regulator may be controlled to be in a bypass mode. To this end, the regulator control circuit may send one or more control signals (e.g., an active bypass enable signal) to cause the voltage regulator to be controlled for bypass operation. As such, an incoming supply voltage is directly provided to power one or more logic circuits of the integrated circuit. Understand while shown at this high level in the embodiment of FIG. 2, many variations and alternatives are possible.

Figure 3:
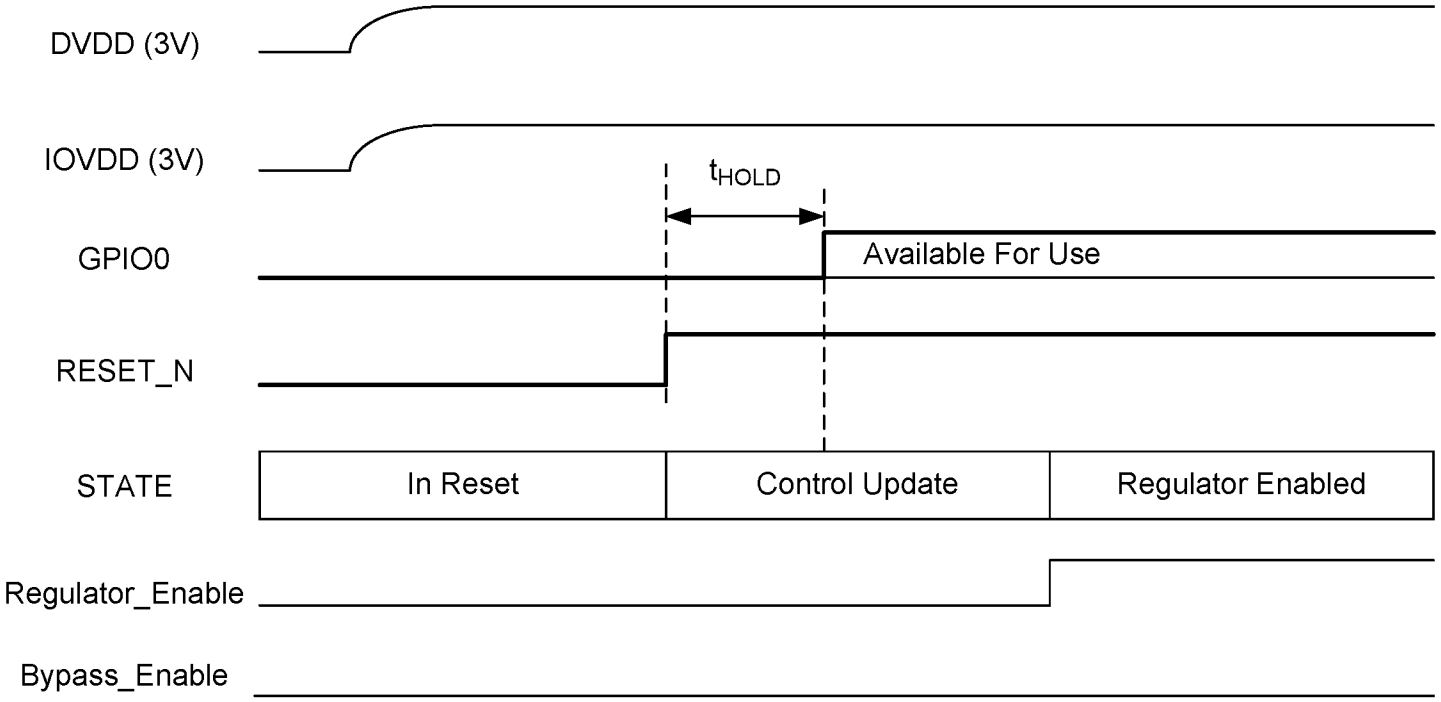
FIG. 3 is a timing diagram illustrating control of a voltage regulator for an enabled mode.

Referring now to FIG. 3, shown is a timing diagram illustrating control of a voltage regulator for an enabled mode. As illustrated in FIG. 3, multiple voltage sources are provided to the integrated circuit via a first power pad and a second power pad. As seen in the embodiment of FIG. 3, each of these supply voltages may be at the same level (namely 3 volts). As the logic circuitry to be powered at a lower voltage level could be adversely impacted by such high voltage, FIG. 3 shows an example in which the voltage regulator is controlled for an enabled mode, such that a lower, regulated voltage is provided to such logic circuitry. Thus as illustrated, a control signal is received (via GPIO0 pin/pad) at an inactive or low level. Accordingly, when reset is released (by way of the high transition in RESET_N), the regulator control circuitry may perform a control update operation to configure the voltage regulator for the enabled mode. Thus as illustrated, the regulator control circuitry outputs an enable signal (Regulator_Enable) at an active or high level. At the same time, the control circuitry may also output an enable bypass signal (Bypass_Enable) at an inactive or low state. Based on this active enable signal (namely the Regulator_Enable signal), a bypass path coupled in parallel to the voltage regulator may be disabled (e.g., by opening one or more switches) to thus enable the voltage regulator to operate in the enabled mode, receiving and regulating a given voltage to output a regulated voltage.

Note that with an embodiment herein, after the control update occurs continued operation of the integrated circuit is in the configured mode, here the enabled mode. As a result, after a given time duration following the control update, the GPIO pad/pin on which the control signal was received may be used for any other desired purpose. More specifically as shown in FIG. 3, following a hold time ($t_{HOLD}$) this GPIO pad/pin is available for another use. As such, this GPIO pad/pin is an overloaded pad/pin, such that it can be used to provide control signaling during boot up, e.g., for the voltage regulator control described herein, and thereafter any desired signaling may occur on this GPIO pad/pin. Stated another way, after reset release, the overloaded pad/pin may be freely available for any other use during integrated circuit operation. Note that this boot-time configuration use of the GPIO pad/pin may not be exposed to end users (or even certain purchasers of the integrated circuit) such as by way of publication of this feature within a data sheet for the integrated circuit. In such cases, this feature may remain hidden to customers and end users, and usable only by a manufacturer of the integrated circuit (or its delegate) for purposes of testing, debugging or so forth.

Figure 4:
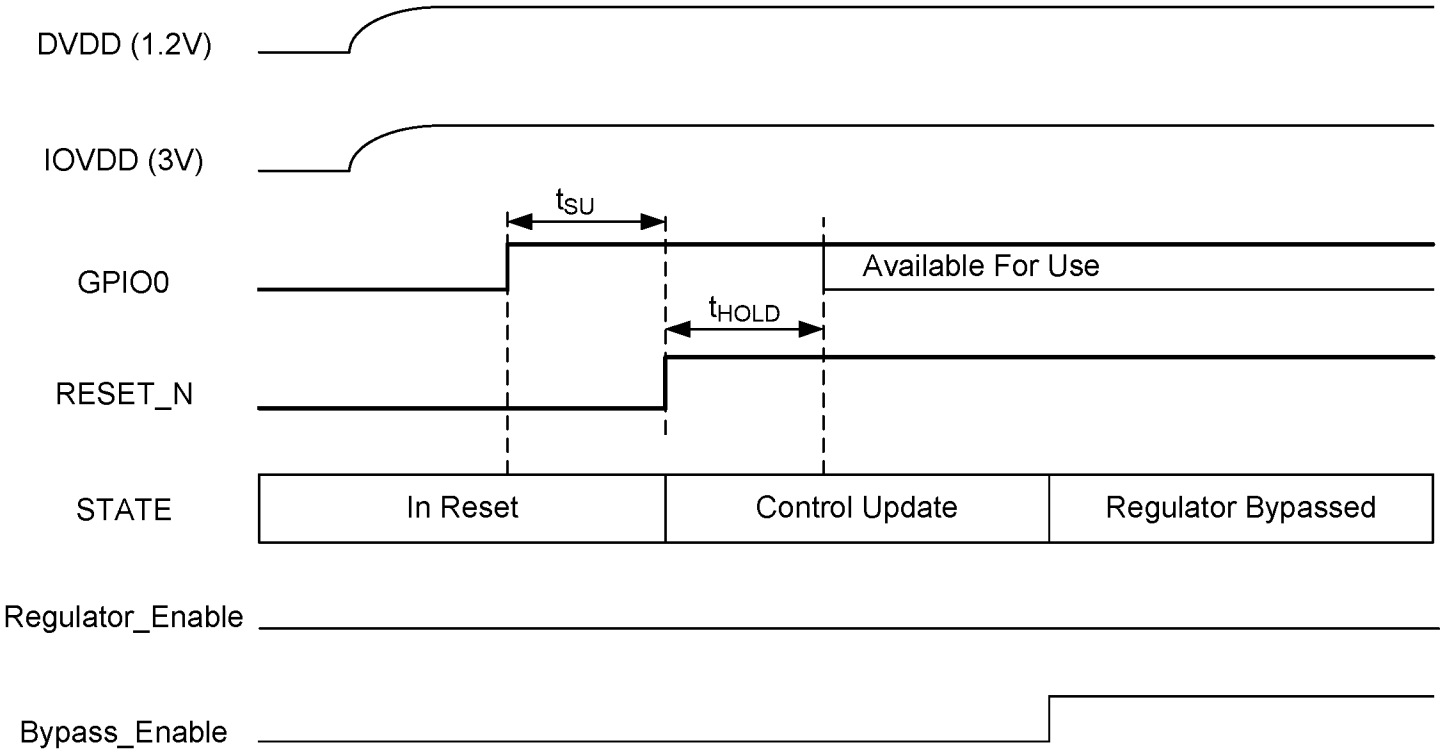
FIG. 4 is a timing diagram illustrating control of a voltage regulator for a bypass mode.

Referring now to FIG. 4, shown is a timing diagram illustrating control of a voltage regulator for a bypass mode. As illustrated in FIG. 4, multiple voltage sources are provided to the integrated circuit via a first power pad and a second power pad. As seen in the embodiment of FIG. 4, the first supply voltage is at a high voltage (e.g., 3 volts) and the second supply voltage is at a low voltage (e.g., 1.2 volts). With this lower supply voltage, it is safe to directly power logic circuitry with this voltage, and thus in FIG. 4 the voltage regulator is controlled for the bypass mode, such that this lower unregulated supply voltage can be provided directly to certain logic circuitry. Thus as illustrated, a control signal is received (via GPIO0 pin/pad) at an active or high level (which may transition high during a setup time, $t_{SU}$). Accordingly, when reset is released (RESET_N low-to-high transition), the regulator control circuitry may perform a control update operation to configure the voltage regulator for the bypass mode. Thus as illustrated, the regulator control circuitry outputs an inactive or low level enable signal (Regulator_Enable). At the same time, the control circuitry also outputs a bypass signal (Bypass_Enable) at an active or high state. Based on this active bypass signal (namely the Bypass_Enable signal), a bypass path coupled in parallel to the voltage regulator is enabled (e.g., by closing one or more switches) to thus enable the voltage regulator to operate in the bypass mode, such that the low supply voltage is directly provided to logic circuitry. And after a hold time, the pad/pin providing the control circuit is available for another purpose.

Note that the above embodiments may provide a restriction to an end user, such that the overloaded pad should not be set to an active state on reset release when the supply voltage provided to the voltage regulator is at a high voltage level (e.g., 3 volts). If this situation were to occur, the voltage regulator would be bypassed and this high supply voltage would be applied directly to logic circuitry, such as transistors and other devices that may potentially be damaged by this high supply voltage.

Thus in other embodiments it is possible to mask the use of a GPIO pin (or other suitable pin such as GPI pin), for purposes of providing a control signal during boot up. Specifically, this pin may be identified in a data sheet and other documentation to customers and end users as a ground pin. As such, no user would provide a high voltage to that pin, avoiding the potential for damage as per the situation described above. With this documentation indication of a pin as a ground pin, end users may maintain this pin grounded outside the integrated circuit, such that an undesired high logic value on this pin is not received. Note that in such embodiments, even though this pin is identified in customer-facing documentation as a ground pin, internal to the integrated circuit, the pin does not connect with a chip ground.

Figure 5:
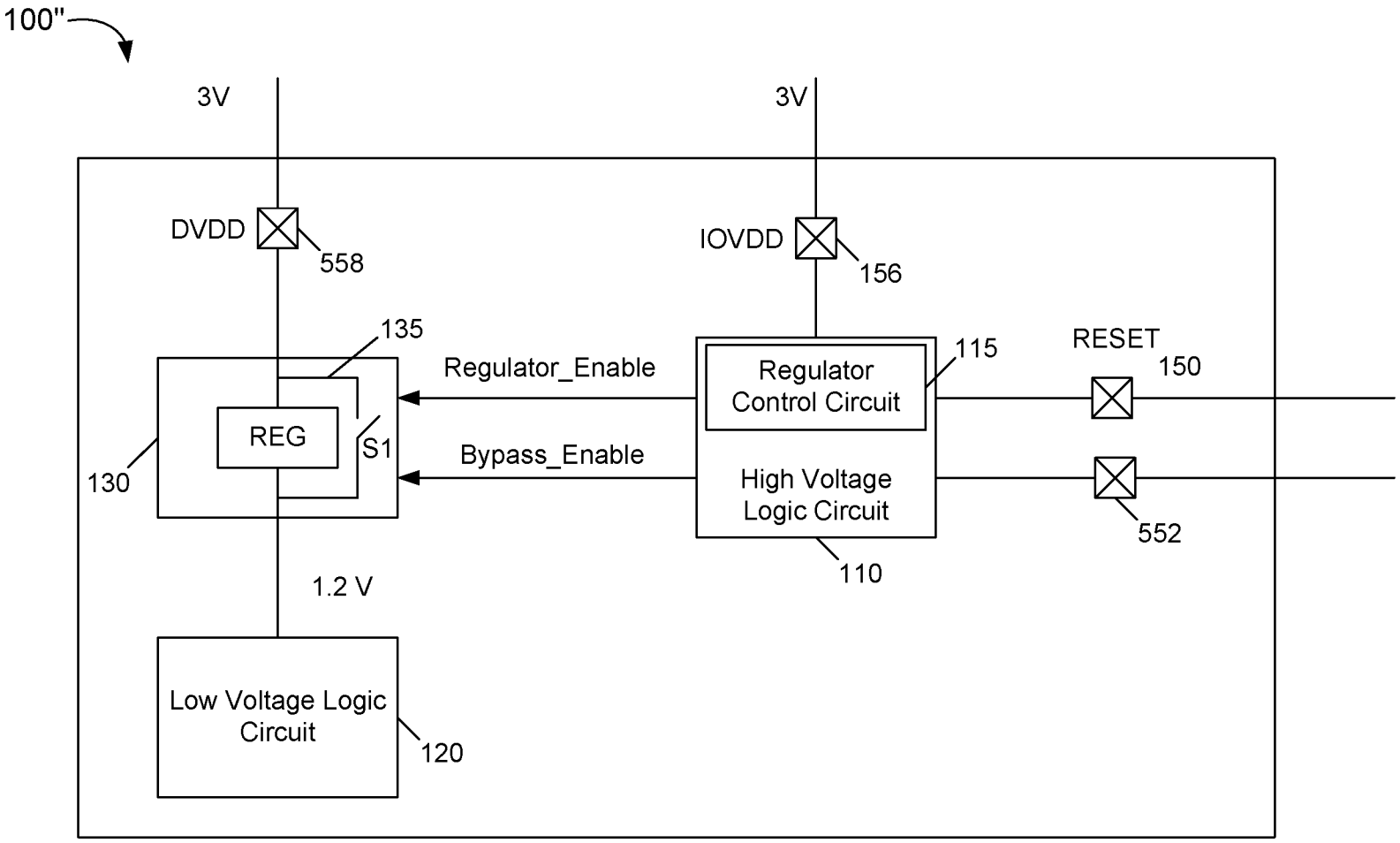
FIG. 5 is a block diagram of an integrated circuit in accordance with another embodiment.

Referring now to FIG. 5, shown is a block diagram of an integrated circuit in accordance with another embodiment. More specifically as shown in FIG. 5, integrated circuit 100" may be implemented substantially the same as integrated circuit 100 of FIG. 1A, and thus the same reference numerals are used to refer to the same components. However, in this embodiment, instead of using a GPIO pin/pad to communicate a control signal, another pad 552 (e.g., a GPI pad) provides the control signal to regulator control circuit 115. And power pad 558 may couple to a supply voltage at a high level (e.g., 3.0 volts). With this configuration and identification in a data sheet of pad 552 being a ground pad, inadvertent high signaling on this pad during a boot mode that could trigger a bypass mode that would provide the high voltage directly to second logic circuit 120 may be prevented. Note that with this arrangement as in FIG. 5, pad 552 may not be usable for other purposes during normal operation. That is, by marking this pad as a ground pad in data sheets and other customer documentation, the pin may be maintained to always be coupled to a low voltage level, ensuring that low voltage logic circuit 120 is not provided with a potentially damaging higher voltage (e.g., a 3.0V as provided on power pad 558).

Figure 6:
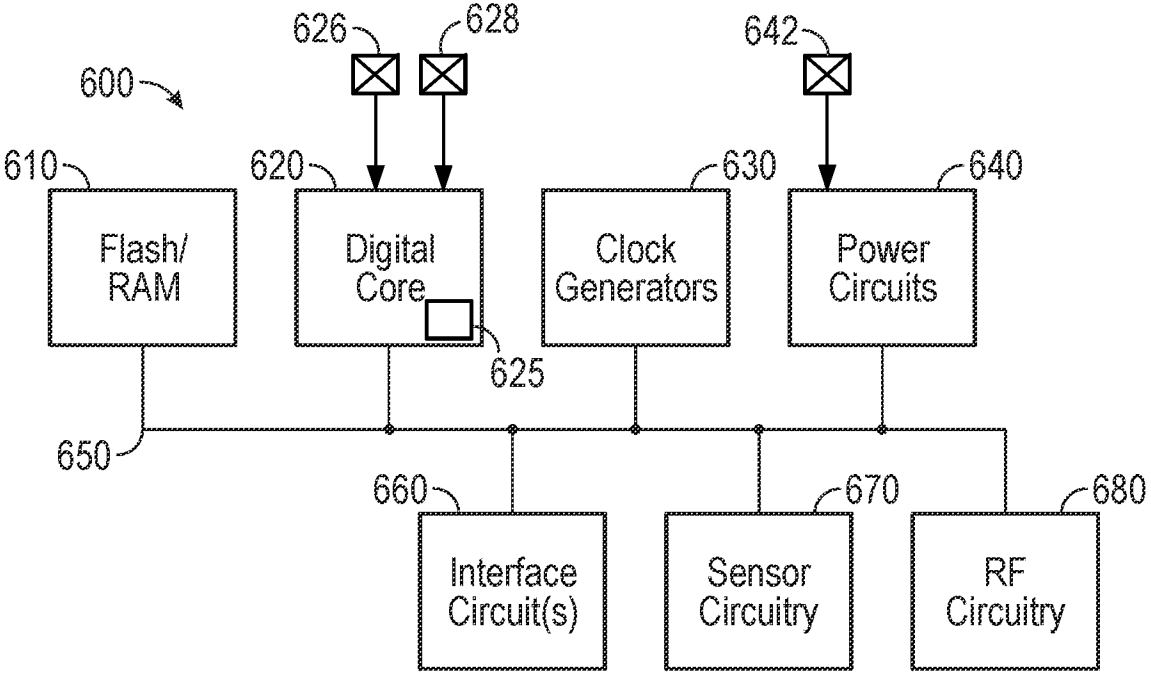
FIG. 6 is a block diagram of a representative integrated circuit in accordance with an embodiment.

Referring now to FIG. 6, shown is a block diagram of a representative integrated circuit 600 which may include a control circuit to control a voltage regulator or other component of IC 600 during boot up operations, using limited pin support as described herein. In the embodiment shown in FIG. 6, integrated circuit 600 may be, e.g., a microcontroller, wireless transceiver or other device that can be used for a variety of use cases, including sensing, monitoring, embedded applications, communications, applications and so forth. In the embodiment shown, integrated circuit 600 includes a memory system 610 which in an embodiment may include a non-volatile memory such as a flash memory and volatile storage, such as RAM. Memory system 610 couples via a bus 650 to a digital core 620, which may include one or more cores and/or microcontrollers that act as a main processing unit of the integrated circuit. As illustrated, digital core 620 is configured to receive incoming signal information via multiple pins 626 and 628. In embodiments herein, these pins may provide, respectively, a reset signal and a control signal for purposes of controlling an on-chip voltage regulator at boot up. To this end, digital core 620 includes a regulator control circuit 625 which may operate as discussed above with regard to, e.g., FIG. 1A. In turn, digital core 620 may couple to clock generators 630 which may provide one or more phase lock loops or other clock generation circuitry to generate various clocks for use by circuitry of the IC.

As further illustrated, IC 600 further includes power circuitry 640. Such power circuits may include one or more voltage regulators as described herein. As illustrated, at least one power pad 642 may provide a voltage to power circuitry 640, including as an input to a voltage regulator, which may have a bypass circuit coupled thereto, to enable control of the voltage regulator to operate in an enabled mode or a bypass mode, depending upon the state of signaling via pads 626 and 628 during boot, as described herein.

As further illustrated in FIG. 6, additional circuitry may optionally be present depending on particular implementation to provide various functionality and interaction with external devices. Such circuitry may include interface circuitry 660 which may provide interface with various off-chip devices, sensor circuitry 670 which may include various on-chip sensors including digital and analog sensors to sense desired signals or so forth. In addition as shown in FIG. 6, RF circuitry 680 may be provided which may include analog circuitry of a transceiver to enable transmission and receipt of wireless signals, e.g., according to one or more of a local area or wide area wireless communication scheme, such as Zigbee, Bluetooth, IEEE 802.11, cellular communication or so forth. Understand while shown with this high level view, many variations and alternatives are possible.

With embodiments as described herein, special capabilities for controlling a voltage regulator or other component of an integrated circuit may be provided with reduced pin counts. As described above, a GPIO pin, ground pin or so forth may be used to provide control signaling during boot operation such as may be used during debugging or testing. Note however that this special control signaling may remain transparent or not visible to at least certain customers and/or end users. That is, a data sheet for the integrated circuit may not identify this special control functionality. Instead, the pads/pins on which this control signaling occurs can simply be identified as a pin intended for a given function in end usage cases, e.g., as a GPIO pin, ground pin, GPI pin, reference pin, or so forth.

Embodiments thus enable reduction in pin counts, including a reduction in an additional power pin that would otherwise be required to provide a lower external supply voltage to certain logic circuitry of the integrated circuit. As such, embodiments enable two different manners of booting up an integrated circuit, namely using an on-chip voltage regulator in an enabled mode or using an external supply voltage when the voltage regulator is controlled to operate in a bypass mode.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. An integrated circuit comprising:

a single semiconductor die comprising:

a voltage regulator to receive a first voltage and regulate the first voltage to output a regulated voltage;

a first logic circuit to operate using the regulated voltage;

a regulator control circuit to receive a control signal during a boot of the integrated circuit via a general purpose input/output (GPIO) pad of the integrated circuit and control the voltage regulator to operate in one of an enabled mode and a bypass mode based at least in part on the control signal;

a first power pad to receive a first supply voltage, the first power pad coupled to the regulator control circuit to provide the first supply voltage to the regulator control circuit; and a second power pad to receive a second supply voltage, the second power pad coupled to the voltage regulator to provide the second supply voltage to the voltage regulator.

2. The integrated circuit of claim 1, further comprising a bypass circuit coupled between the second power pad and the first logic circuit.

3. The integrated circuit of claim 1, wherein in the bypass mode, the second power pad is to receive a third supply voltage, the third supply voltage less than the second supply voltage, and a bypass circuit is to provide the third supply voltage to the first logic circuit.

4. The integrated circuit of claim 1, wherein in the enabled mode, the second power pad is to receive the second supply voltage and provide the second supply voltage to the voltage regulator.

5. The integrated circuit of claim 2, wherein the regulator control circuit is to send at least one signal to the bypass circuit to control the bypass circuit.

6. The integrated circuit of claim 1, wherein the regulator control circuit is to register a state of the control signal in response to a release of a reset signal.

7. The integrated circuit of claim 6, wherein when the state of the control signal is active, the regulator control circuit is to control the voltage regulator to operate in the bypass mode.

8. The integrated circuit of claim 1, wherein the GPIO pad comprises an overloaded pad to receive the control signal during the boot of the integrated circuit and to receive at least one other signal during normal operation of the integrated circuit.

9. The integrated circuit of claim 1, wherein the regulator control circuit is to control the voltage regulator to operate in the bypass mode during a debug operation on the integrated circuit, and otherwise to control the voltage regulator to operate in the enabled mode.

10. A method comprising:

in response to a release of a reset signal provided to an integrated circuit via a reset pin, registering a state of a second signal provided to the integrated circuit via a second pin, wherein after the reset signal release, the second pin is useable for another function;

in response to the registered state being a first state, controlling a voltage regulator of the integrated circuit for a bypass mode in which a first external supply voltage provided to the integrated circuit via a third pin is to power at least one logic circuit of the integrated circuit; and in response to the registered state being a second state, controlling the voltage regulator for an enabled mode in which the voltage regulator regulates the first external supply voltage to provide a regulated voltage to the at least one logic circuit.

11. The method of claim 10, further comprising overloading the second pin with another signal for the another function after the reset signal release.

12. The method of claim 10, further comprising executing a scan operation on the integrated circuit using the first external supply voltage while the voltage regulator is controlled for the bypass mode.

13. The method of claim 10, further comprising receiving a general purpose input/output signal via the second pin after the reset signal release.

14. The method of claim 10, further comprising receiving the state of the second signal in a regulator control circuit of the integrated circuit, the regulator control circuit powered by the first external supply voltage provided via the third pin.

15. The method of claim 10, further comprising receiving the state of the second signal in a regulator control circuit of the integrated circuit, the regulator control circuit powered by another external supply voltage provided to the integrated circuit via a fourth pin of the integrated circuit.

16. An apparatus comprising:

a first pin to receive a reset signal to indicate a reset of the apparatus;

a second pin to receive a control signal during a boot of the apparatus, and after a release of the reset signal to receive another signal;

a voltage regulator to receive a first supply voltage and regulate the first supply voltage to output a regulated voltage;

a control circuit to receive the control signal via the second pin and the reset signal via the first pin during the boot of the apparatus, and control the voltage regulator to operate in one of an enabled mode and a bypass mode based on a state of the control signal at the release of the reset signal; and a first logic circuit to operate using the first supply voltage when the voltage regulator is to operate in the bypass mode and using the regulated voltage when the voltage regulator is to operate in the enabled mode.

17. The apparatus of claim 16, further comprising:

a first power pad to receive the first supply voltage, the first power pad coupled to the voltage regulator to provide the first supply voltage to the voltage regulator; and a second power pad to receive a second supply voltage, the second power pad coupled to the control circuit to provide the second supply voltage to the control circuit.

18. The apparatus of claim 17, further comprising a bypass circuit coupled between the first power pad and the first logic circuit, wherein in the enabled mode the bypass circuit is disabled and the first power pad is to receive a third supply voltage, the third supply voltage greater than the first supply voltage, and in the bypass mode the bypass circuit to provide the first supply voltage to the first logic circuit.

* * * * *